United States Patent [19]

Makara et al.

[11] 4,276,818

[45] Jul. 7, 1981

[54] AIR DISTRIBUTOR

[75] Inventors: György Makara; Andras Morlin; Andras Fozo; Robert Fülöp, all of Budapest, Hungary

[73] Assignee: Fütöber Épületgépészeti Termékeket Gyártó Vállalat, Budapest, Hungary

[21] Appl. No.: 19,096

[22] Filed: Mar. 9, 1979

[30] Foreign Application Priority Data

Mar. 10, 1978 [HU] Hungary ..... FU 359

[51] Int. Cl.[3] ..... F24F 7/00

[52] U.S. Cl. ..... 98/40 B; 98/41 R; 98/41 AV

[58] Field of Search ..... 98/35, 40 R, 40 A–40 D, 98/40 V, 40 VM, 64, 80, 81, 83, 122, 41 R, 41 AV; 239/474–475, 490, 518, 520, 523–524; 415/121 G, 207, 217

[56] References Cited

U.S. PATENT DOCUMENTS

| | | | |
|---|---|---|---|
| 1,562,865 | 11/1925 | Brown | 98/122 |
| 2,200,014 | 5/1940 | Wolf | 98/80 |
| 3,509,811 | 5/1970 | Topp | 98/83 |
| 3,854,386 | 12/1974 | Hedrick | 98/40 B |

*Primary Examiner*—Louis J. Casaregola

*Attorney, Agent, or Firm*—Karl F. Ross

[57] ABSTRACT

An air distributor has a connecting pipe and a baffle spaced from the mouth of this pipe while a crown of vanes is disposed between the baffle and the pipe mouth.

10 Claims, 4 Drawing Figures

AIR DISTRIBUTOR

FIELD OF THE INVENTION

The invention relates to an air blower distributed by means of which air is blown into a space so that the pressure of the injected air is higher than the air pressure prevailing in the space.

BACKGROUND OF THE INVENTION

Earlier known air distributor have numerous disadvantages with respect to the mixing of this air with the air of the space, the slowing of the air, the necessary connection pressure and the uniform ventilation of the space. A primary disadvantage is that a plate disposed ahead of the mouth of the connecting pipe distributes the impinging air stream so that the stream also includes radial velocity components. The air stream flowing radially from the opening becomes, as a result of the rapidly increasing flow cross section, significantly slower even at a relatively limited distance, i.e. loses its injection velocity before the injected air has intensively mixed with the air of the space. Because of the failure of an intensive mix, the temperature difference between the air of the space and the injected air remains in large measure which results in drafts in personnel-containing spaces especially when cold air is injected.

There are air distributor structures known in which a corresponding mixing and deceleration of the injected air can be attained. These constructions, however, operate with high connection pressure and involve significant ventilation power; in spite of the high connection pressure, the ventilation air quantity displaced is low.

With distributor construction having a baffle and a vane grid, it is not possible to so reduce the volumetric flow of the injected air so that the injected air stream is uniformly distributed for mixture with the air already in the space. On the contrary, with this construction there is an increasing danger of air drafts as a result of the reduction of the flow. A further disadvantage of the known devices is that adjustment of the injected air quantity to a desired value in the connection pipe or in the connecting air duct for throttling the connection pressure, requires an especially costly throttle element. It is also possible to adjust the vane grid for throttling of the air stream; however this adjustment affects the uniform velocity distribution of the outflowing air stream and the vane grid, which can be visible, may have an unsatisfactory esthetic appearance because of its asymmetric setting.

In the construction of devices with air distributors it is important to ensure that the injected air, especially when it is colder than the air of the space, mixes as completely as possible with the air of the space before it enters the portions of the space occupied by people. In addition, the flow velocity must be reduced to a value which does not permit the detection of drafts. The selected flow rate must be established and controlled with the air distributor itself so that even with low pressure differentials a relatively large volumetric flow is provided; simultaneously it must also be possible to establish the flow rate at a low value with large pressure differentials so that drafts and undesirable noise or disturbing acoustic phenomena do not occur.

These contradictory requirements result in compromises with conventional air distributors so that each aspect can be improved only to detriment of the others.

In order to decelerate the air at a reduced distance, a baffle of one or more elements is provided ahead of the opening of the connecting pipe to divert the air to radially outward streams.

One can use as a baffle, circular planar plates, lying mainly perpendicular to the axis of the connecting pipe, or bodies of rotation.

The rear plate surrounding the connecting tube is thus so used that the ventilation air is diverted into radially outward streams between the rear and front baffles. The open space between the front and rear baffles is preferably optically shielded from an esthetic viewpoint. For this purpose, one or more circular plates can be arranged between the rear and front baffles or flat plates are erected in radial planes or cylindrical rods can be provided between the rear and front baffles as optical grids which influence the radially outward flow of the air as little as possible.

With this air insufflator construction, the radially outward streams of air are associated with a very low flow resistance. To adjust the volumetric flow of the injected air, adjustable throttle structures are generally built into the connecting pipe which operate to set the flow cross section. Sometimes these throttle structures are also built into the flow cross section between the rear and front baffles. A known device has throttle plates between the rear and front baffles so that they are open condition in the radial direction but, upon throttling are closed pairwise in opposite directions of rotation. A further variant of the latter for a radial flow air distributor is built into the building structure subdivided into rooms, for example, in a roof, whereby the elements of the body of rotation forming the front baffle are parallel to the building structure and are fastened in the vicinity of the plane at which the unit is mounted.

An air distributor having a radially widening vortex air stream is described, for example, in Hungarian Pat. No. 179,824. Vortex formation is here effected by feeding the air in a tangential direction within the injector device, the radial outflow of the air is obtained with a foreplate applied to the outlet opening but which does not overlie the outlet opening but rather extends parallel thereto. It is a characteristic of the construction that the reduced pressure found in the core of the vortex draws air from the space through an opening provided for this purpose in the foreplate and premixes it.

A similar solution is described in German Pat. No. 2,421,120 which relates to a rectangular air injector construction in which the air is fed laterally through a pipe connected to a large box and at its inlet into the box is diverted by a vertical guide plate ahead of the mouth opening onto a sealing distribution grid at the bottom of the box to achieve a uniform outflow of air. A vortex movement is generated in the box with an effectiveness which is sharply influenced by the rectangular cross section of the box and the rectangular cross section of the grid.

Both devices have the disadvantage that the vortex formation can be realized in the radially expanding air stream only with unusually high pressure losses and thus with considerable loss in fan work.

A known transition between axial and radial vortex injector constructions is the semiaxial proposal of Soviet Pat. No. 231,085. The vortex is generated in a special worm element into which the air is radially introduced. The pressure loss in this solution is high. The outflow of air and its distribution is effected by a conically shaped surface disposed ahead of the worm element.

The known axial vortex injector constructions have the additional disadvantage that the vortex movement of the air has a proportionally small outer surface of the air in contact with the air in the space and which serves to bring about mixing.

The known radial vortex injector constructions have the common characteristics that the expanding air stream is close to a boundary surface of the building, for example close to the ceiling so that mixing with the room air can take place only at one side of the stream.

It is also disadvantageous with this construction that control of the quantity of the inblown air requires the intervention of special expensive throttle structures.

OBJECTS OF THE INVENTION

The object of the invention is to provide an air distributor which obviates the above described disadvantages, also the disadvantages of vortex injection devices. Associated with this object is that the ventilating air, which can be very cold, mixes intensively at a short distance with the air of the space, that the air stream widens uniformly in the space and that its velocity even after a short stretch drops below the value associated with drafts, and that these objects are attained with a pressure drop which is as small as possible.

Also associated with the object is that relatively high connecting pressures can be throttled and that this throttling can occur without acoustic disadvantages, without the integration of special structural elements and only with the setting of the positions of individual structure elements of the air insufflator construction.

SUMMARY OF THE INVENTION

The subject of the invention is thus an air distributor having at its main structural elements a connecting pipe, a foreplate or front baffle and a vane crown or grid. According to the invention, in the space between the mouth opening of the connecting pipe and the front baffle, advantageously provided with an opening, there are provided at least two vanes or plates forming the vane crown and projecting from the connecting pipe arranged externally of the latter.

According to a further feature of the invention, a perpendicular to a plane tangent to the outlet edge of the vane at the contact point with the latter includes an angle of less than 85° with a line drawn through this point and perpendicular to the symmetry axis of the connecting pipe. The vanes are arranged around the symmetry axis of the connecting tube with the same direction of rotation.

According to a further feature of the invention, the vanes are of arcuate shape and are convex as viewed from the center of the mouth opening to the symmetry axis of the connecting pipe. The vanes of the vane crown can be stiff surfaces. They can, however, also be composed of sail fabric material and in this case their shape can alter in dependence upon the air stream.

The vanes can be fixedly or adjustably fastened on the usual elements of the structure. The setting of the vanes can be effected by means of hand adjustment independently from one another; they can, however, also be adjusted either individually or together by means of a servomotor. In the region of the mouth opening of the connecting pipe there is found a rear plate surrounding same of the usual form. The foreplate can be composed of one or more elements. These can be adjusted either collectively or each by itself. The foreplate composed of one or more elements is adjustable in the direction of the mouth opening or the rear plate to a degree such that the outlet cross section for the air can be either completely or partially blocked. The vanes of the vane crown each have a pivot axis journaled in the foreplate and in the rear plate. The vanes are adjustable about these pivot axes so that the outlet area for the air can be closed. A throttle structure for partially covering the flow cross section is arranged in the connecting pipe. Both the foreplate and the rear plate can independently from one another have the configuration of a planar surface or of a body of rotation. The spacing of the rear plate from the boundary of the aerated room, (e.g. from the wall) is greater than 100 mm.

The main advantage of the air distributor of the present invention is that it generates a radially expanding air stream which in the region of the distributor independently mixes with the air in the space and thereby falls in velocity over a short stretch below the velocity at which drafts may occur, this advantage being reached with surprisingly low pressure losses.

Advantageously, furthermore, both sides of the radially discharged and expanding air stream remain free for the intensive mixing with the air of the space.

With the construction according to the invention, the quantity of injected air can be controlled, the vortex formation can be adjusted in the air stream without requiring special expensive structural elements.

These advantages are assured by the use of a foreplate of usual shape composed of one or more elements located ahead of the discharge cross section and ensuring a radial flow of air. The air impinges on the latter and is diverted into a radial flow. Because at least two vanes are disposed in the space between the mouth opening and the foreplate, the air possesses a twist. The vanes can also be formed with a domed configuration although they in each case are always oriented in the same sense. Because of this arrangement of the foreplate and the vanes, the inflow resistance is very low. The space between the foreplate and the mouth opening can be closed at the rear side (turned away from the foreplate) by a rear plate. This rear plate has a predetermined spacing from the boundary surface of the building. In this manner it is assured that both sides of the vortex stream are able to mix with the room air. By means of the adjustable vanes, the air stream is so controlled that the vortex formation is not reduced but, on the contrary, is increased. If the control is effected by an adjustment of the foreplate, the degree of vortex formation remains unchanged.

BRIEF DESCRIPTION OF THE DRAWING

FIG. 1 shows the assembly of the structure, in

SPECIFIC DESCRIPTION

Figure 1:
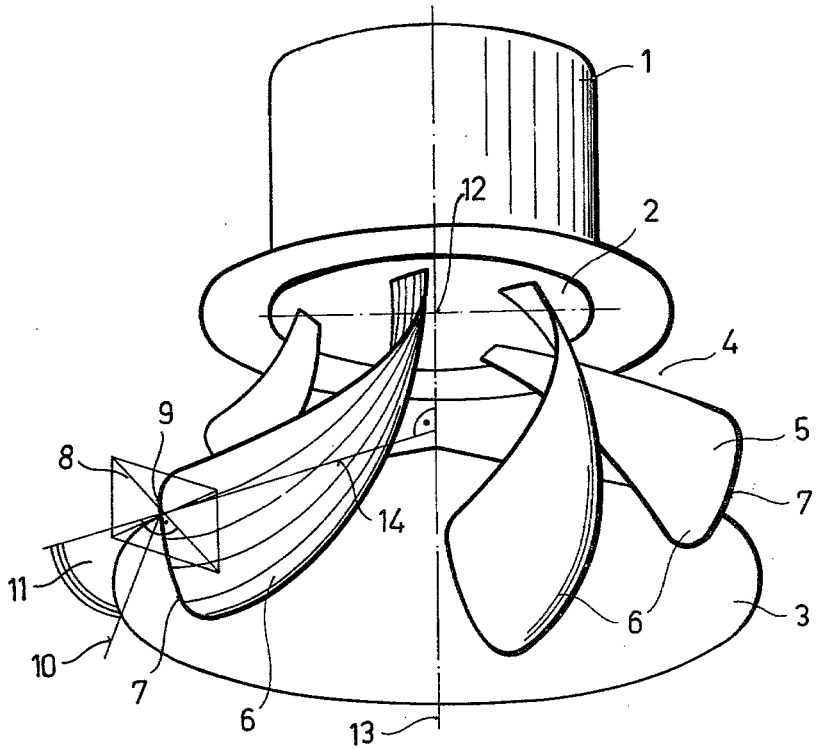

As FIG. 1 shows, a foreplate or baffle 3 is arranged opposite the of the air-supply conduit opening 2. In the space 4 between mouth opening 2 of the connecting pipe 1 and the foreplate 3, there is provided a vane crown 6 with vanes 5 designed to deflect the air into a vortex movement. A plane 8 is tangent to the outlet edge 7 of the vane 5 at a contact point 9 from which a line 10 extends perpendicular to the plane and includes an angle of less than 85° with a line perpendicular to the connecting pipe 1 and drawn through the contact point 9 and perpendicular to the symmetry axis 13 of the connecting pipe 1.

Figure 2:
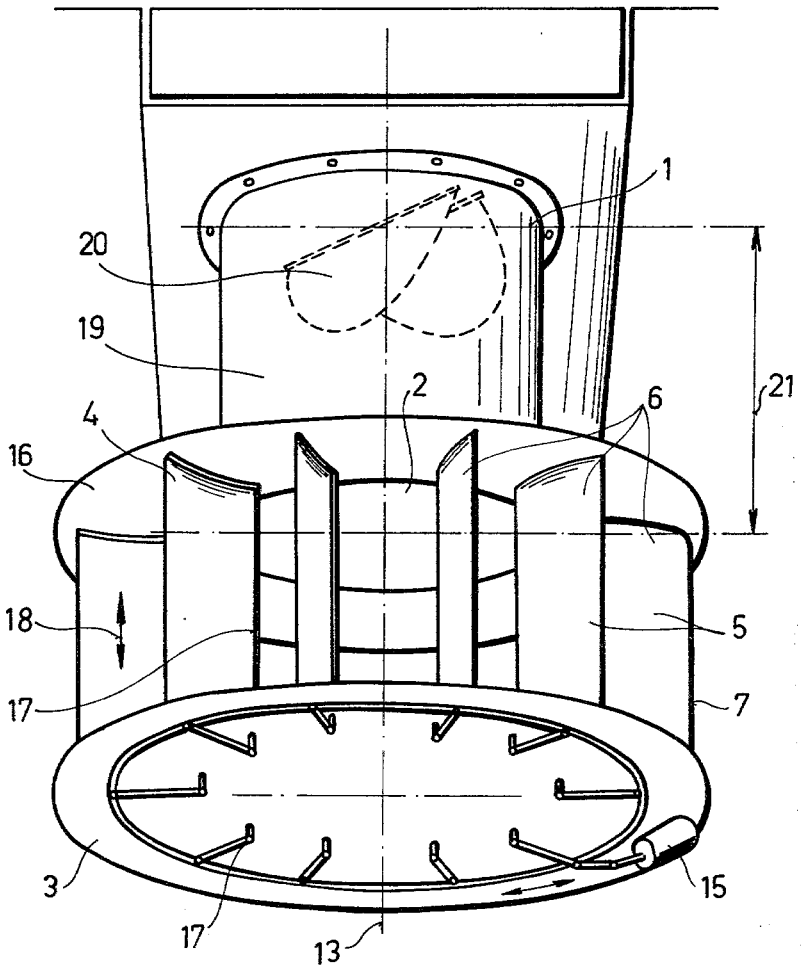
FIG. 2 an embodiment provided with curved vanes is shown.

FIG. 2 shows another embodiment. In this one the vanes are curved with the curvature such that the vane appears to be convex away from the symmetry axis 13. The vanes are arranged in the same direction of rotation between the planar rear plate 16 and the planar foreplate 3.

The vanes 5 are rotatable about their axes 17. They are adjusted by the servomotor 15. By the adjustment of the vanes 5, the output cross section can be fully closed. For presetting, a butterfly flap 20 is provided as a throttle element in the flow cross section 19 of the connecting pipe 1.

Between the rear plate 16 and the building wall, a space 21 is maintained free so that both sides of the air stream can participate in mixing with the room air.

Figure 3:
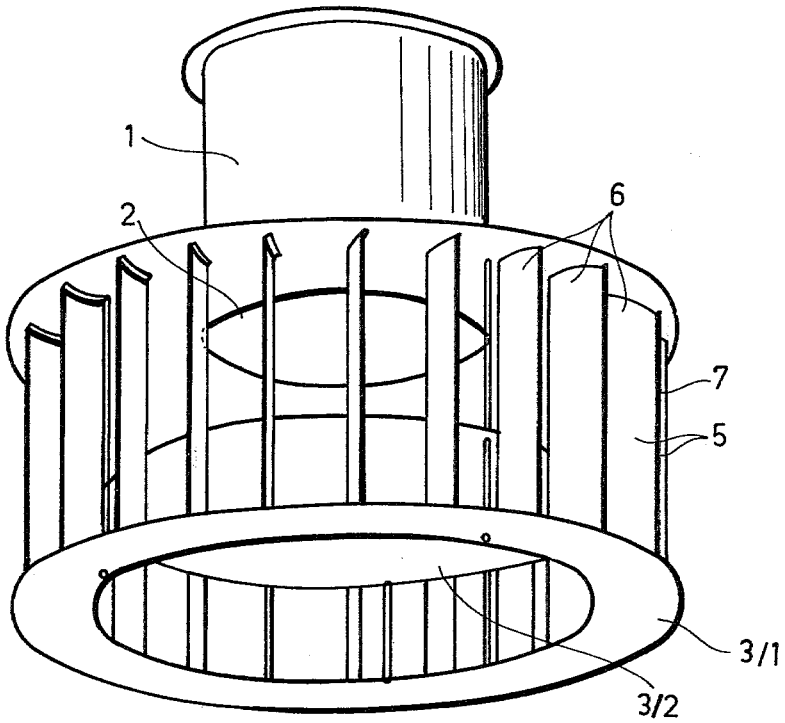
FIG. 3 depicts an embodiment in which the foreplate comprises two parts.

FIG. 3 shows a similar embodiment in which the foreplate 3 comprises two parts. With the movable part 3/2 of the foreplate, the output cross section 18 can be altered. The part 3/1 holds the vane crown.

Figure 4:
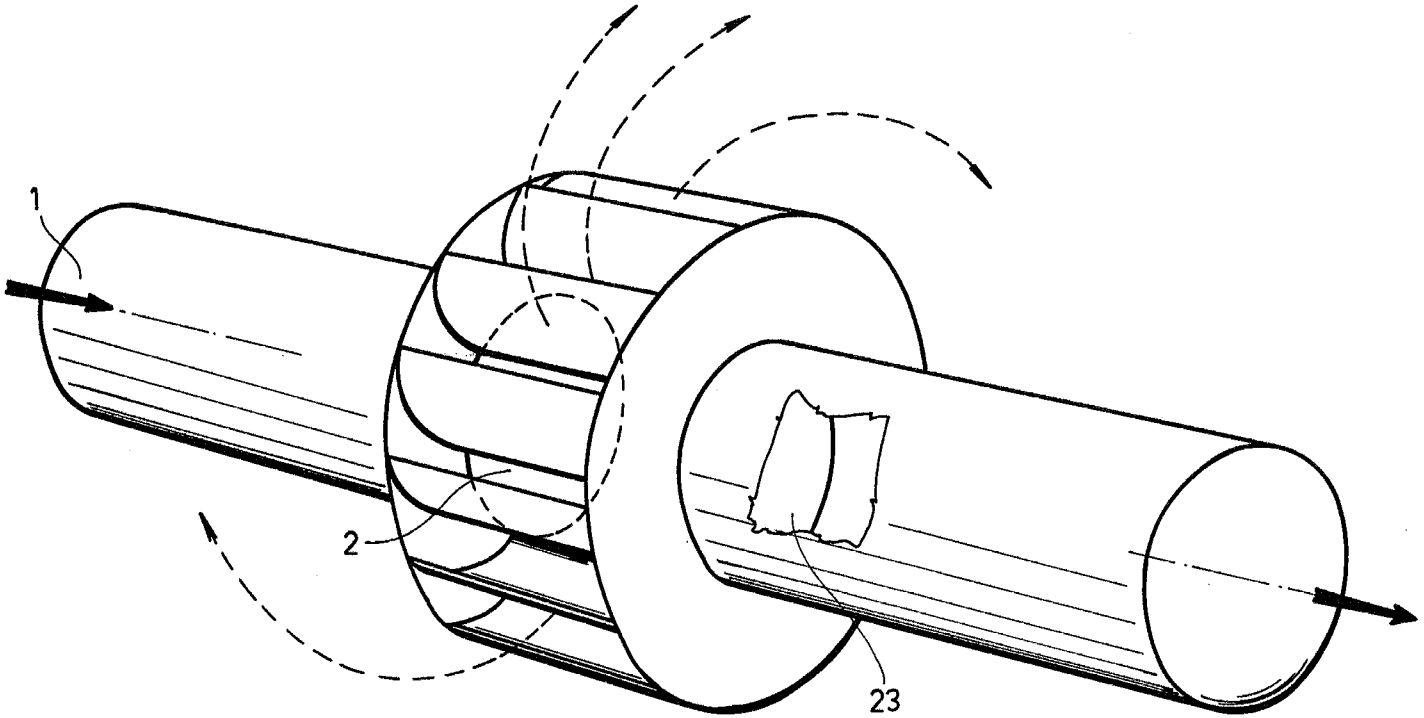
FIG. 4 illustrates an embodiment in which the foreplate has an opening.

FIG. 4 illustrates an embodiment in which the foreplate 3 manifests an opening 23 permitting the further flow of the gaseous medium. The mouth opening 2 has the same size as or a greater cross section than the opening 23 formed in the foreplate 3. The air insufflator construction according to the invention can be used primarily with ventilating and air conditioning units operating with cold air.

We claim:

1. An air distributor for injecting air into a space in which the injected air is mixed with the air of the space, said distributor comprising:

a cylindrical connecting pipe having an axially open circular air-discharge mouth;

a baffle plate of larger diameter than said mouth and axially spaced therefrom in the direction of flow of air from said mouth while being aligned therewith; and a vane crown between said pipe and said plate, said vane crown comprising a multiplicity of angularly equispaced curved vanes disposed at least predominantly outwardly of an axial projection of said mouth on said plate for imparting vortex movement to air emerging from said mouth and impinging on said plate.

2. The distributor defined in claim 1 wherein said vanes are shaped so that a line perpendicular to a plane tangent to an outermost edge of each vane includes an angle of less than 85° with a line perpendicular to the axis of said pipe drawn through the tangent point.

3. The distributor defined in claim 1 wherein all of said vanes are oriented in the same sense about the axis of said pipe.

4. The distributor defined in claim 1 wherein said vanes are composed of fabric.

5. The distributor defined in claim 1, further comprising means for individually adjusting orientations of each of said vanes independently of the other vanes of said crown.

6. The distributor defined in claim 1, further comprising a servomotor mounted on said baffle plate and connected to said vanes for adjusting the orientation thereof.

7. The distributor defined in claim 1, further comprising a rear plate lying in a plane of said mouth and affixed to said pipe.

8. The distributor defined in claim 1 wherein said baffle plate is adjustable along said axis relative to said mouth.

9. The distributor defined in claim 1, further comprising means forming a pivot axis parallel to the axis of said pipe whereby said vanes are swingable relative to said baffle plate.

10. The distributor defined in claim 1, further comprising a butterfly throttle in said plate upstream of said mouth.

* * * * *